US005369391A

United States Patent [19]

Gadsby

[11] Patent Number: 5,369,391

[45] Date of Patent: Nov. 29, 1994

[54] SUN POWERED ELECTRICALLY OPERATED CHIME APPARATUS

[76] Inventor: David E. Gadsby, 322 Greenwoods Dr., Lakeland, Fla. 33813

[21] Appl. No.: 801,280

[22] Filed: Dec. 2, 1991

[51] Int. Cl.[5] ..... G08B 3/00; G10K 1/00

[52] U.S. Cl. ..... 340/392.5; 340/393.2; 340/395.1; 116/141

[58] Field of Search ..... 340/392, 396, 384 R, 340/693, 395, 394, 403, 402; 116/141

[56] References Cited

U.S. PATENT DOCUMENTS 5,072,208 12/1991 Christensen ..... 340/392

FOREIGN PATENT DOCUMENTS 2208254 3/1989 United Kingdom ..... 340/392

*Primary Examiner*—Donnie L. Crosland

*Attorney, Agent, or Firm*—Richard L. Miller

[57] ABSTRACT

An electrically operated chime apparatus is provided and consists of a plurality of resonating members for producing audible sounds, attached to a suspended mounting plate and freely hanging therefrom. A mechanism, operated by electrical power which may be optionally produced by a solar collector, is provided for randomly striking the resonating members, thereby causing the resonating members to produce the audible sounds.

5 Claims, 1 Drawing Sheet

SUN POWERED ELECTRICALLY OPERATED CHIME APPARATUS

BACKGROUND OF THE INVENTION

The instant invention relates generally to wind chimes and more specifically it relates to an electrically operated chime apparatus.

Numerous wind chimes have been provided in the prior art that are adapted to produce audible sounds caused by the movement of air current thereabout. For example, U.S. Pat. Nos. Des. 272,810 to Stilson; Des. 279,873 to Neely; Des. 297,129 to Anderson and 4,854,214 to Lowe all are illustrative of such prior art. While these units may be suitable for the particular purpose to which they address, they would not be as suitable for the purpose of the present invention as hereafter described.

SUMMARY OF THE INVENTION

A primary object of the present invention is to provide an electrically operated chime apparatus that will overcome the shortcomings of the prior art devices.

Another object is to provide an electrically operated chime apparatus that includes a mechanism operated by electrical power for randomly striking resonating members hanging therefrom to produce audible sounds.

An additional object is to provide an electrically operated chime apparatus in which the electrical power can be obtained from a solar collector electrically connected to a motor which rotates a clapper that randomly strikes the resonating members.

A further object is to provide an electrically operated chime apparatus that is simple and easy to use.

A still further object is to provide an electrically operated chime apparatus that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
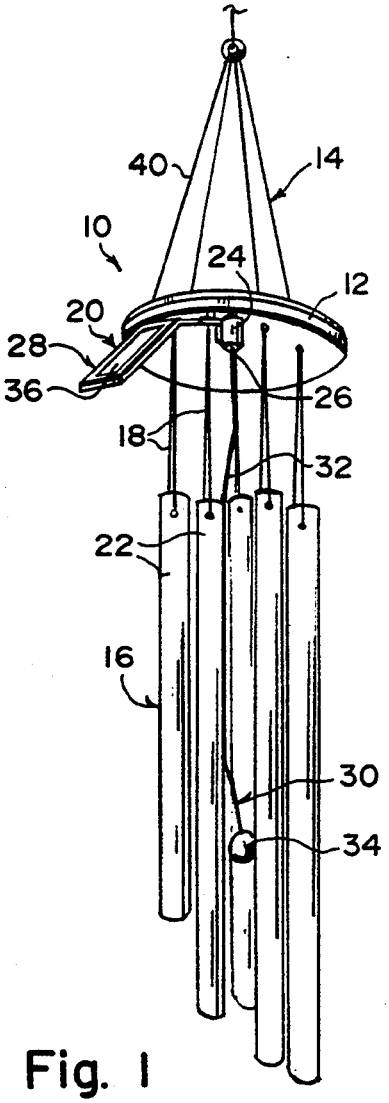
FIG. 1 is a perspective view of the instant invention suspended by a wire hanger.
Figure 2:
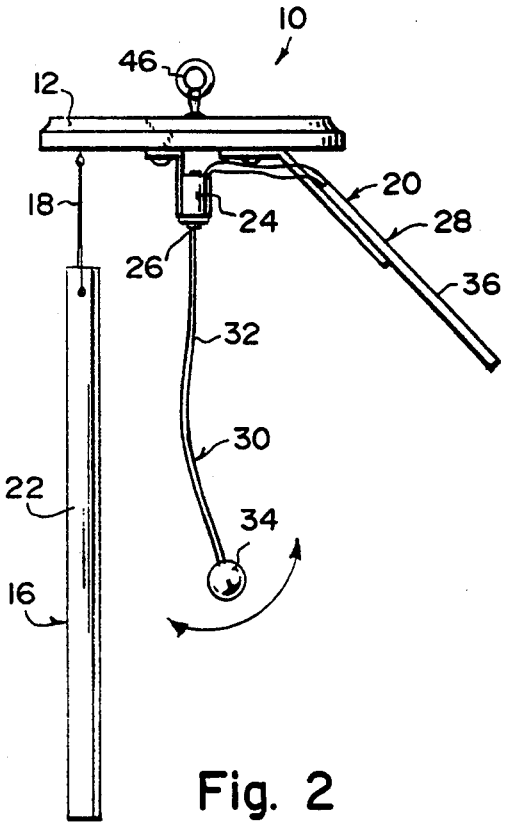
FIG. 2 is a side view with parts removed so that the cord and bead of the clapper can be better seen hanging downwardly from the motor shaft.

Turning now descriptively to the drawings, in which similar reference characters denote similar elements throughout the several views, the Figures illustrate an electrically operated chime apparatus 10 which consists of a mounting plate 12, with a structure 14 for suspending the mounting plate 12. A plurality of resonating members 16 for producing audible sounds are attached to the mounting plate 12 by support cords 18 freely hanging therefrom. A mechanism 20 operated by electrical power is for randomly striking the resonating members 16, thereby causing the resonating members 16 to produce the audible sounds.

Each of the resonating members 16 includes a hollow elongated chime tube 22. The chime tubes 22 can be of varying lengths to produce different audible sounds.

The randomly striking mechanism 20 includes an electric motor 24 attached to the underside of the mounting plate 12, so that the shaft 26 of the electric motor 24 extend downwardly. A power source 28 is electrically connected to the electrical motor 24. A clapper 30 is flexibly attached to the shaft 26 of the electric motor 24 and freely hangs therefrom. The clapper 30 is adapted to randomly swing and collide with the chime tubes 22 when the clapper 30 is rotated by the shaft 26 of the electric motor 24, thereby causing the chime tubes 22 to produce the audible sounds.

The clapper 30 includes an elongated cord 32 attached to the shaft 26 of the electric motor 24. A bead 34 is connected to the distal end of the elongated cord 32 which will randomly strike the chime tubes 22. The power source 28, as shown in the drawings, can be a solar collector 36 affixed to the mounting plate 12 which is electrically connected to the electric motor 24. The power source 28 can also be a battery or AC current, not shown. An on-off safety switch 38 can also be used to disconnect the power source 28 from the electric motor 24.

Figure 3:
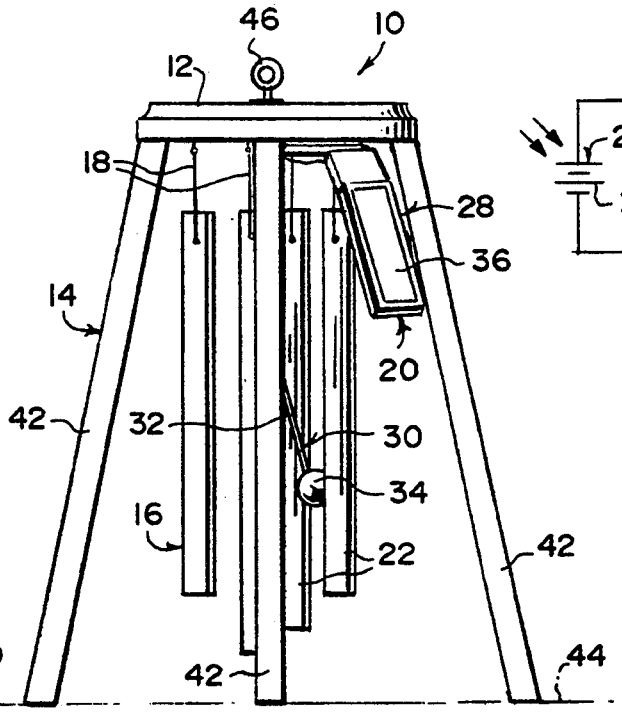
FIG. 3 is an elevational view showing an embodiment of the entire instant invention supported by a tripod arrangement of legs.
Figure 4:
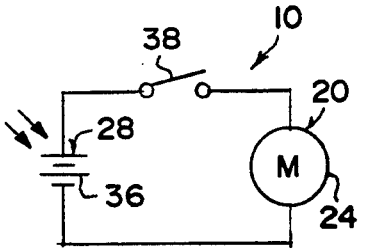
FIG. 4 is an electrical schematic of the instant invention.

The suspending structure 14, as shown in FIG. 1, can be a hanger 40 on the top of the mounting plate 12, which can be connected to an existing support, now shown. The suspending structure 14, as shown in FIG. 3, can be a plurality of legs 42 spaced apart and extending downwardly about the perimeter of the mounting plate 12 to elevate it about a flat surface 44, such as the ground or the like. Alternatively the instant invention can be suspended by a wire (not shown) attached to an eye member 46 secured to mounting plate 12.

If the power source 28 is the solar collector 36 the apparatus 10 can be used as an alarm by placing it outdoors or in a window indoors, so that the rays of the sun can enable the solar collector 36 to operate the electric motor 24 at daybreak. If the power source 28 is not the solar collector 36, the apparatus 10 can be placed indoors and in some instances used as a bell.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An electrically operated chime apparatus which comprises:

a) a mounting plate;

b) means for suspending said mounting plate;

c) a plurality of resonating members for producing audible sounds, attached to said mounting plate and freely hanging therefrom;

d) an electric motor attached to the underside of said mounting plate, so that the shaft of said electric motor extends downwardly;

e) a solar collector affixed to said mounting plate and electrically connected to said electric motor; and f) a clapper comprising an elongated cord having a first end attached to the shaft of said electric motor and a bead attached to a second end of the cord so as to freely hang therefrom to randomly swing and collide with said chime tubes when said clapper is rotated by the shaft of said electric motor, thereby causing said chime tubes to produce the audible sounds.

2. An electrically operated chime apparatus as recited in claim 1, wherein each of said resonating members includes a hollow elongated chime tube.

3. An electrically operated chime apparatus as recited in claim 1, wherein said suspending means includes an eye member secured to a top surface of said mounting plate which can be connected to an existing support.

4. An electrically operated chime apparatus as recited in claim 3, where said suspending means includes a plurality of legs spaced apart and extending downwardly in divergent fashion about the perimeter of said mounting plate.

5. An electrically operated chime apparatus as recited in claim 1, wherein said suspending means includes a plurality of legs spaced apart and extending downwardly in divergent fashion about the perimeter of said mounting plate.

* * * * *